US006811899B2

(12) United States Patent
Inoue

(10) Patent No.: US 6,811,899 B2
(45) Date of Patent: Nov. 2, 2004

(54) COATED TOOL FOR WARM-AND/OR-HOT WORKING WITH SUPERIOR GALLING RESISTANCE PROPERTY AND SUPERIOR WEAR RESISTANCE

(75) Inventor: Kenichi Inoue, Yasugi (JP)

(73) Assignee: Hitachi Metals, Ltd., Tokyo (JP)

( * ) Notice: Subject to any disclaimer, the term of this patent is extended or adjusted under 35 U.S.C. 154(b) by 80 days.

(21) Appl. No.: 10/107,194

(22) Filed: Mar. 28, 2002

(65) Prior Publication Data

US 2003/0059632 A1 Mar. 27, 2003

(30) Foreign Application Priority Data

Mar. 30, 2001 (JP) ..... 2001-098588
Apr. 10, 2001 (JP) ..... 2001-111706

(51) Int. Cl.[7] ..... B32B 15/18
(52) U.S. Cl. ..... 428/698; 76/DIG. 11
(58) Field of Search ..... 428/698, DIG. 11; 419/5; 75/231

(56) References Cited

U.S. PATENT DOCUMENTS 6,284,366 B1 * 9/2001 Konig et al. ..... 428/336

FOREIGN PATENT DOCUMENTS

| | | |
|---|---|---|
| DE | 19825572 A | 9/1999 |
| DE | 19957668 A | 7/2000 |
| JP | 11-92909 | 4/1999 |
| JP | 11-152583 | 6/1999 |
| JP | 2000-239829 | 9/2000 |
| WO | 0052223 A | 8/2000 |

* cited by examiner

*Primary Examiner*—Daniel Jenkins
(74) *Attorney, Agent, or Firm*—Sughrue Mion, PLLC

(57) ABSTRACT

A coated tool for warm-and/or-hot working with a superior galling resistance property and a superior wear resistance, comprising: a base material selected from the group consisting of a hot die steel and a high speed steel; and a coating as a working surface, the coating having: a layer "a" provided on said base material, the layer "a" being made of at least one kind selected from the group consisting of a nitride, a carbide and a carbonitride, each of which contains as the main constituent thereof at least one metal element selected from the group consisting of Ti, V, Cr, Al and Si; and a layer "b" provided on the layer "a", the layer "b" being made of a sulfide.

12 Claims, 3 Drawing Sheets

COATED TOOL FOR WARM-AND/OR-HOT WORKING WITH SUPERIOR GALLING RESISTANCE PROPERTY AND SUPERIOR WEAR RESISTANCE

BACKGROUND OF THE INVENTION

The present invention relates to a coated tool for warm-and/or-hot working such as a forging die etc. used in circumstances where metals are in sliding contact with each other in a warm or hot condition.

As for a conventional tool for the warm-and/or-hot working, a hot working die steel defined in JIS-SKD61 or JIS-SKT4 is usually used, and in a case where the durability of the die is particularly required, there is used a steel, which has a high-temperature strength higher than that of JIS-SKD61 or JIS-SKT4, such as JIS-SKD7, JIS-SKD8, high speed steel or a steel obtained by improving each of them.

For example, in order to satisfy requirements for a warm-and/or-hot forging die (hereinafter, referred to as "die") such as the enhancement of the working efficiency, the high precision design of a worked product and a near-net-shape design, a nitriding such as a plasma process, a salt bath process or a gas process etc. comes to be used, or a physical vapor deposition coating such as an arc discharging ion plating method etc. (hereinafter, referred to as "PVD") in combination with the nitriding comes to be used, for the purposes of enhancing the wear resistance of the working surface of the die, the anti-seizure property thereof and the heat crack resistance thereof while keeping the toughness of the die.

In JP-A-11-92909, in order to enhance the adhesion strength between a surface of die material and a PVD coating, there are disclosed the regulating of the surface roughness of the surface of the die material to be coated which regulating is performed by use of a diamond paste, the applying of a vacuum gas nitriding, and a washing by a electrolytic process as a pre-treatment to be performed before coating such as CrN or TiAlN which is formed by PVD. Further, JP-A-11-152583 discloses the using of both of a nitriding and the PVD coating of TiN, CrN or TiCrN for the purpose of improving the heat crack resistance and oxidization resistance property of the die surface.

However, each of JP-A-11-92909 and JP-A-11-152583 brings about only the improvement of service life of 20 to 30 percents in comparison with the conventional dies, that is, in these prior arts it is impossible to achieve a drastic improvement of the service life of the die, and these prior arts are not necessarily satisfied insofar as the requirements such as the improvement of the working efficiency, the high precision design of the worked product and the near-net-shape design are concerned.

Particularly, since the near-net-shape design of the worked product causes the shape of a product to become complex, not only the rate of a metal flow of the worked material increases, but also a stress applied to the working surface of the die increases during the working, so that seizure, galling and so on come to occur between the working surface of the die and a worked material at an early stage of an operating. One of the factors causing this problem is thought to be the breaking-off of a lubricant occurring by the severity of the forging condition.

The occurrence of the seizure, galling and so on come to cause excessive friction forces at the interface defined between the working surface of the die and the worked material, so that much friction-heat occurs. As the result thereof, the material is extremely softened at a surface portion of the die due to the heat, and the coating on the die surface is easily peeled off so that the wear resistance of the die is extremely deteriorated. Depending on the product shape, there occurs such a case as the temperature of the die becomes a high temperature exceeding the transformation point of the die material itself (700~900° C.), that is, a circumstance to which the die is exposed becomes very severe.

In addition, the complication of the product shape due to the near-net-shape design of the worked product causes a great variation of the metal flow rate of the worked material in dependence on the location of the die. In other words, at an early stage of the forging in which the surface temperature of the die is unstable, the surface temperature of the die raised due to the friction-heat occurring between the worked material and the die comes to be greatly varied in dependence on the location thereof.

SUMMARY OF THE INVENTION

Regarding the warm-and/or-hot forging, the present inventors have found the phenomenon and problems explained below. In the warm-and/or-hot forging, although a lubricant is applied by spraying after every each forging operation, the lubricant has such a characteristic as the largest amount of adhered lubricant at a particular die surface temperature. That is, the fact that the surface temperature greatly varies in dependence on the location thereof means that the amount of the lubricant present on the die also varies greatly in dependence on the location thereof, and there occurs such an unfavorable state as a suitable amount of lubricant is present regarding certain positions and as a lubricant-shortage or no lubricant occurs at other positions. Of course, at the position where the amount of the adhered lubricant is low, seizure galling and so on between the die and the worked material is apt to occur at an early stage of the forging.

Nowadays, the PVD coating used for the warm-and/or-hot forging die is improved mainly regarding the adhesion strength between the die surface and the coating, so that there occurs such a problem as the premature seizure and/or galling are caused when the die having the coating is used in the circumstance in which the amount of the lubricant varies as explained above or in which the friction heat is caused very much, so that the coating is peeled off without sufficiently exerting its effect.

An object of the present invention is to provide a coated tool for warm-and/or-hot working with superior anti-seizure property and wear resistance, which tool can solve the above problems.

The inventors of the invention have investigated in detail regarding the influences of each of the composition of the PVD coating, the layered structure of the coating and the coating on each of the adhesion of the lubricant applied onto the warm-and/or-hot working tool and the anti-seizure property thereof.

As the result thereof, the inventors have found that, by coating on the die surface of a warm-and/or-hot working tool a layer of at least one of nitride, carbide and carbonitride which layer contains as the main constituent thereof at least one metal element selected from the group consisting of Ti, V, Cr, Al and Si, and by coating on this layer another layer of a sulfide, it is possible to obtain a superior anti-seizure property and a superior wear resistance both required in the tool for warm-and/or-hot working. According to this, it is confirmed that, in a case of, for example, a hot forging die provided with this layered structure, it becomes possible to sufficiently suppress a local seizure at an initial stage of the forging and to suppress excessive heating occurring due to the sliding contact between a worked material and the die after a middle stage of the forging, and that the service life of the hot-forging die is remarkably enhanced.

That is, according to the first aspect of the invention, there is provided a coated tool for warm-and/or-hot working with a superior anti-seizure property and a superior wear resistance, comprising: a base material selected from the group consisting of a hot die steel and a high speed steel; and a coating as a working surface, the coating having: a layer "a" provided on the base material, the layer "a" being made of at least one material selected from the group consisting of a nitride, a carbide and a carbonitride, each of which contains as the main constituent thereof at least one metal element selected from the group consisting of Ti, V, Cr, Al and Si; and a layer "b" provided on the layer "a",the layer "b" being made of a sulfide.

The layer "b" of the sulfide preferably contains, by atomic % in terms of only metal compositions, at least one not more than 50% (including 0%) in total selected from the group consisting of Ti and Cr and the balance substantially Mo, and the layer "b" preferably has a thickness of 0.5~10 μm.

In the invention, the superior anti-seizure property and superior wear resistance can be obtained by, for example, providing the sulfide layer "b" as the outermost layer of the coating. Further, by regulating the surface roughness of the outermost layer to a predetermined value, the amount of the lubricant present on the surface can be increased, which is particularly effective at the early stage in which the surface temperature of the tool is unstable.

Namely, it is preferable that, as the outermost layer of the coating, there exists a layer "c" having a surface roughness of Rz: 4~15 μm which layer "c" contains as the main constituent thereof at least one metal element selected from the group consisting of Ti, V, Cr, Al, Si and Cu, and it is preferred that the layer "c" has a thickness of 2~15 μm.

Furthermore, the layers of the coating are preferably formed by the physical vapor deposition, and it is preferred that the coated substrate or material has at a depth of 25 μm from the outermost surface of the coated substrate or material a hardness higher, by not less than 200 HV0.2, than that of a portion of 500 μm depth, in which the "HV0.2" is a mark defined in JIS-Z-2244 which mark shows a Vickers hardness measured under a load of 1.961 N.

BRIEF DESCRIPTION OF THE DRAWINGS

Other objects and aspects of the present invention will become apparent from the following description of embodiments with reference to the accompanying drawing in which.

DESCRIPTION OF THE PREFERRED EMBODIMENTS

Figure 1:
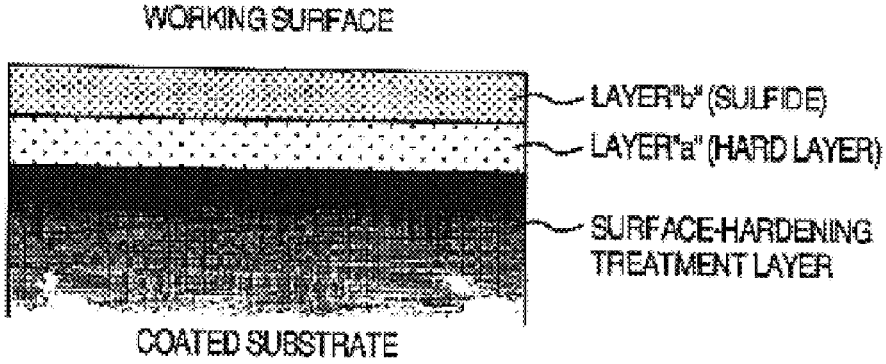
FIG. 1 is a schematic cross sectional view showing the structure of the layers of the coating formed as the working surface of a coated tool for warm-and/or-hot working embodying the invention.

First, in the coated tool for warm-and/or-hot working embodying the present invention is used a material of an excellent hot strength as the substrate of the tool on which substrate the coating is formed. As the material, a steel material, which has been conventionally used for producing a warm-and/or-hot working tool in the prior art, may be used, and specifically a hot working die steel and a high-speed steel defined by JIS and a steel obtained by improving each of them may be used. At first, the layer "b" of the coating is described below.

In general, a coating made by a PVD process such as TiN, CrN or TiAlN is usually used because of its hardness remarkably high in comparison with that of a nitrided layer made by a plasma nitriding, gas nitriding or salt bath nitriding etc. For example, the nitrided layer has a hardness of 1000~1100HV although this value varies in dependence on the composition of a material to be surface-treated, however, the TiN has a hardness of 2000~2200HV, the CrN having a hardness of 1800~2000HV, and the TiAlN has a hardness of 2400~2700HV, the range of which hardness of the coating formed by the PVD process is more than about twice that of the nitrided layer. Therefore, the coating formed by the PVD process is naturally expected to have a superior wear resistance.

The inventors of the invention have made researches regarding circumstances under which the die for warm-and/or-hot working is used and regarding characteristics required for the surface treatment thereof, and have found that in the conventional PVD coating, an galling resistance property which is one of the essential factors required for the warm-and/or-hot working die is not enough.

In the invention, it is important that the layer "b" made of the sulfide is coated on the high hardness layer "a" explained below. The sulfide is generally known as a solid lubricant which lowers a friction coefficient in a sliding part used under the condition of a room temperature, however, according to the researches of the present inventors it is found that the sulfide is remarkably effective to improve the galling resistance property even in a high temperature condition.

Table 1 shows the results of hot forging tribo-simulations performed to evaluate the galling resistance property at a high temperature regarding the samples, each of which was prepared by the steps of: working a material of JIS-SKH 51 (having a hardness of 60 HRC) into a columnar test piece of 5 mm in diameter and 20 mm in length; and providing on a test portion thereof with a diameter of 5 mm a coating of a kind different each other by use of the PVD process. The hot forging tribo-simulations were performed by the steps of: attaching one end of each of the test pieces to a chuck of a drilling machine; forcing the coating of the test piece onto a block of JIS-SNCN 439 at a predetermined pressure which block had a size of 30 mm×30 mm and a thickness of 20 mm and which block was heated up to 600° C., while rotating the chuck at a speed of 1540 rpm; and causing the coating to be in sliding contact with the block in a period of 40 seconds at maximum. In this test, the evaluation was performed in such a manner as a specific load at which the test piece was buckled due to the friction heat with a galling occurring on the block is supposed to be a maximum specific load without galling.

TABLE 1

| Coating structure | Maximum specific load without galling MPa (maximum 200 MPa) |
|---|---|
| TiN single layer | 90 |
| CrN single layer | 95 |
| TiAlN single layer | 90 |
| substrate side TiN + outermost layer $Mos_2$ | 170 |
| substrate side CrN + outermost layer $Mos_2$ | 180 |
| substrate side TiAlN + outermost layer $Mos_2$ | 165 |

From Table 1, it is found that a $MoS_2$ coating formed by sputtering, which is a representative sulfide, on the layer of TiN, CrN or TiAlN has a remarkably high maximum-specific-load without galling in comparison with the PVD coating made of the single layer of TiN, CrN or TiAlN formed by use of the arc discharging ion plating process. As described above, the sulfide, which had been conventionally deemed to have effects only regarding the sliding friction at a room temperature, was found to be sufficiently effective in a hot-working condition. For these reasons, it is necessary in the invention to provide the coating having the hard layer "a" and the layer "b" of a sulfide formed on the layer "a" having the high hardness.

It is preferred that the layer "b" made of the sulfide contains at least one not more than 50% (including 0%) in total in terms of atomic % of metal compositions alone selected from the group consisting of Ti and Cr, and the balance substantially Mo. More specifically, the layer is preferably di-sulfide containing as the main metal constituent thereof Mo (including substantially 100 atomic %). By making the molybdenum sulfide contain Ti and/or Cr, it becomes possible to obtain such an effect as to improve the hardness of the sulfide. However, in a case where the total contents of Ti and/or Cr exceeds 50 atomic % in terms of only metal composition, the effect of improving the galling resistance property of the Mo sulfide decreased. Thus, it is preferred that the layer "b" made of the sulfide contains at least one not more than 50% (including 0%) in total selected from Ti and Cr, and the balance substantially Mo.

Further, the layer "b" preferably has a thickness of 0.5~10 μm. In a case of a thickness less than 0.5 μm, the improvement of the galling resistance property in the hot-working condition is not sufficient, and on the other hand in another case where the layer "b" has a thickness more than 10 μm, the coating is apt to be peeled off in an early stage of the hot working. Therefore, the thickness of the layer "b" is preferably 0.5~10 μm. More preferably, the thickness of the layer "b" is 1~5 μm.

The layer "b" relating to the invention is provided only for improving the galling resistance property, and the wear resistance of the layer "b" is insufficient insofar as the coating formed on the warm-and/or-hot working die is concerned.

Therefore, it is necessary to provide just below the layer "b" and on the die steel the high hardness layer "a" made of at least one of nitride, carbide and carbonitride containing as the main constituent thereof at least one metal element selected from the group consisting of Ti, V, Cr, Al and Si.

The layer "a" relating to the invention may contain one metal element in, for example, a nitride such as TiN, CrN, VN or CrN, or may contain such two metal elements in another nitride such as TiVN, TiAlN, TiSiN, CrSiN, CrAlN or TiAlSiN. In a case where the die has a very complex shape so that a stress concentration is apt to occur at a convex portion, it is preferred to use the coating containing TiN, CrN, VN or TiVN which has a relatively low residual stress and a good adhesion among the above nitrides. On the other hand, in another case where the forging temperature is high so that the oxidization resistance is required regarding the coated surface of the die, the coating containing Al and Si such as TiAlN, TiSiN, CrAlN or CrSiN is preferable.

Only the case of the nitrides is explained above, however, the same thing is also applicable to the cases of the carbides and carbonitrides, and at least one selected from Ti, V, Cr, Al and Si (100 atomic % inclusive in terms of only metal composition) may be used as the main constituent of the layer "a", or boron and other metal elements selected from the groups IV a, V a and VI a may be added thereto by a total amount not mores than 30 atomic % in terms of only metal composition, or by a total amount not more than 10%. Furthermore, the layer "a" may have a multilayer structure having a plurality of layers of at least two kinds selected from the nitride, carbide and carbonitride which have compositions different from each other.

By providing on the high hardness layer "a" the layer "b" of the sulfide as the outermost layer of the tool, it becomes possible to obtain a superior galling resistance property and a superior wear resistance. Further, by regulating the surface roughness of the outermost layer of the coating, the adhesion of the lubricant can be improved, which is effective particularly in the early stage of the use of the die in which early stage the surface temperature of the tool is unstable.

Namely, it is preferred that the coated tool of the invention for the warm-and/or-hot working has a coating having on the layer "b" a layer "c" with a surface roughness of Rz:4~15 μm as the outermost layer of the coating. As described above, the adhesion of the lubricant is one of the essential factors for the warm-and/or-hot working die. It has been found that, regarding this property, the conventional PVD coating is extremely inferior to the nitride layer.

Figure 4:
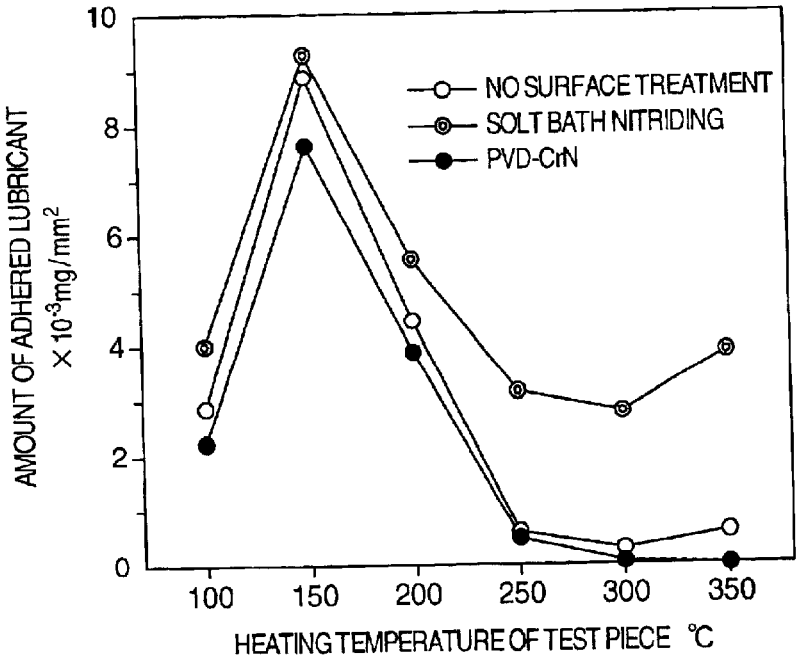
FIG. 4 is a graph showing a relationship between the heating temperature of a surface-treated test piece and the amount of adhesion of the lubricant regarding each of the surface treatments.

FIG. 4 is a graph showing a relation between a temperature of 100 to 350° C. at which a test piece having been previously surface-treated is heated and the weight per a unit area of a lubricant adhered onto the surface of the test piece when a white lubricant (in the name of "HOT AKUARUB #300TK" manufactured by Daido Chemical Industry Co., Ltd.) solution adjusted to have a concentration of 10% was sprayed at a rate of 2.0 ml/s in a distance of 470 mm for 2 seconds. In this test were used three kinds of test pieces, in the first of which no surface treatment was provided thereon, and in the second thereof a coating of CrN is provided by a salt bath nitriding, and in the third thereof another coating of CrN was provided by the PVD process (the arc discharging ion plating).

According to the result thereof, the amount of the lubricant adhesion regarding the salt bath nitride is more than that of the non-treated one, and this tendency becomes remarkable when the test piece is heated to a temperature of 250~350° C., in which temperature range the lubricant is, in general, hardly adhered. On the other hand, the lubricant adhesion of the CrN coating is equal to or less than that of the non-treated one, and it is clear that the adhesion property of the lubricant regarding the PVD coating is obviously inferior to the other surface treatment. Because the inferiority of the PVD coating regarding the adhesion of the lubricant cause the problems in the warm-and/or-hot working, which is particularly serious when the die has such a complex shape as the surface temperature thereof varies in dependence on the locations thereof, there occur locally such portions as the lubricant hardly adheres, so that the galling of the die come to occur.

As the detailed research of the adhered lubricant on the test piece in the test, it is found that the lubricant is solidified on the fine irregularities acting as the nuclei of the solidification and that the adhesion amount of the lubricant increases as the solidification nuclei are fine in size.

In view of this finding, there are prepared test pieces having coatings with different surface roughness by controlling the coating condition of the PVD process, and the relation between the surface roughness and the adhesion amount of the lubricant was examined by use of the same test. In this test, the heating temperature of the test piece was set to be 300° C. at which the lubricant hardly adhered.

In addition, a pure Cr target was used for the coating provided by the PVD process, and the coating was formed at a coating material temperature of 500° C. at a pressure of 3~25 Pa in an argon atmosphere. The surface roughness was controlled by use of the pressure in the layer-forming process. As regards the initial 5 minutes of the coating-forming process, a bias voltage was set to be −100V, and another bias voltage of 0V was used for a period of 30 minutes regarding the last stage thereof. The surface roughness of the test piece was measured with a scanning laser microscope OLS1000 manufactured by Olympus Optical Co., Ltd. for a range of 5 mm in length.

Figure 5:
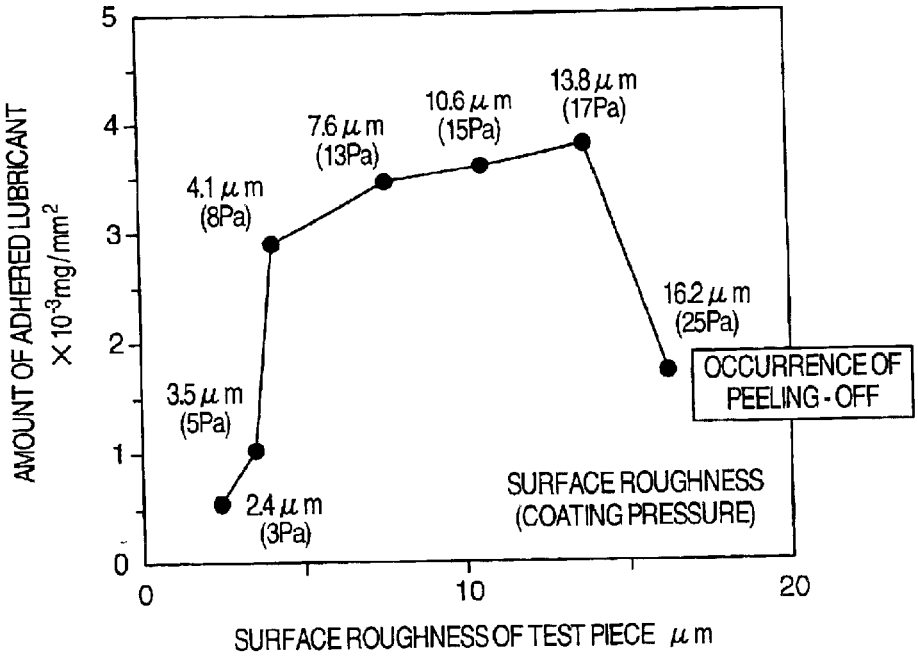
FIG. 5 shows a graph showing a relationship between a surface roughness Rz and an adhesion amount of the lubricant in a case where the test piece is heated at a temperature of 300° C.

As shown in FIG. 5, it has been found that the adhesion amount of the lubricant is remarkably increased when the surface roughness Rz (defined in JIS-B-0601: ten point average roughness)becomes about 4 μm or more, and that the adhesion amount of the lubricant at the surface roughness of about 4 μm or more becomes equal to or better than that of the salt bath nitride of FIG. 4. Further, in a case where the surface rough Rz becomes not less than 16 μm, the PVD coating is peeled off just after the forming of the coating, that is, the applying thereof is difficult to a practical die.

The main function of the layer "c" relating to the invention is to enhance the adhesion amount of the lubricant in an operation where the surface temperature of the die is unstable, and the layer "c" is preferably applied when the adhesion of the lubricant becomes extremely uneven due to the extremely complex shape of the die. In order to obtain this effect of the layer "c", the surface roughness Rz thereof is required to be not less than 4 μm, however, the adhesion of the coating comes to be extremely lowered when the surface roughness exceeds 15 μm. Thus, the layer "c" relating to the invention is set to have a surface roughness Rz of 4~15 μm.

Although there is no limitation regarding the composition or structure of the layer "c", it is preferred for the layer "c" to contain as the main constituent thereof at least one metal element selected from Ti, V, Cr, Al, Si and Cu, because of the reasons explained below.

The metal elements of Ti, V, Cr, Al and Si regarding the composition of the layer "c" are related to the coating of the layer "a" made of at least one of nitride, carbide and carbonitride containing as the main constituent thereof at least one metal element selected from the group consisting of Ti, V, Cr, Al and Si, which layer "a" is formed on the die steel to be coated and which layer "a" is indispensable for the coated tool for the warm-and/or-hot working. For example, in a case of using the sputtering process or the arc discharging ion plating process regarding the PVD, it is required to prepare metal targets of different kinds when a metal element forming the layer "a" is different from that of the layer "c", which increases the number of the kinds of the expensive target to thereby increase unfavorably the cost of forming the coating.

However, the reason why Cu is selected as the preferred metal element for the layer "c" is exceptional, that is, by providing the layer "c" of Cu having a large heat conductivity, a drying time of the lubricant is decreased and the adhesion amount of the lubricant is remarkably increased, which effects are prominent in comparison with the other metals such as Ti, V, Cr, Al and Si and are effective in a circumstance in which the lubricant is hardly adhered. In view of this reason, the layer "c" is preferably made of as the main constituent thereof at least one metal element selected from the group consisting of Ti, V, Cr, Al, Si and Cu. Regarding the main constituents of the layer "c", the total amount thereof is not less than 50 atomic %, preferably is not less than 70 atomic % when copper is selected which is particularly effective, and most preferably is not less than 90 atomic % (substantially 100 atomic % inclusive), and the specific amount thereof is selected while taking the composition of the layer "a" into consideration so that the production cost of the coating may be lowered.

Further, the layer "c" preferably has a thickness of 2~15 μm. In a case where the layer has a thickness less than 2 μm, the layer is early lost without exerting the advantage thereof when the load is extremely high during the working. On the other hand, in another case where the layer is formed to have a thickness more than 15 μm in thickness, the layer is apt to be peeled off in an early stage of the working in dependence on the coating-forming condition. Therefore, the layer "c" preferably has a thickness of 2~15 μm.

By properly roughening the surface of the layer "c", the layer "c" acts to improve the adhesion of the lubricant, and particularly the layer "c" functions as a layer of improving the lubricant adhesion required at an initial stage of the forging with the result that it prevents the occurrence of the seizure of the tool. Even in a case where the layer "c" is lost due to the wear thereof at a middle stage of the forging, the superior galling resistance property of the coating is maintained by both of the sulfide layer "b" present just under the layer "c" and the subsequent, high hardness layer "a".

As described above, the coated tool for warm-and/or-hot working embodying the invention has the substrate of the hot die steel or the high speed steel, and the above described coating on at least an working surface thereof, and as a definite preferable example to obtain such effects, the layer "a" of the present invention is formed on the substrate. As a specific example thereof preferred to obtain the advantage, the tool is provided with the layer "a" coated on the substrate, and the layer "b" formed on the layer "a" as the outermost layer of the tool.

Further, by providing the third layer "c" on the layered coating including the layers "a" and "b", it is possible for the coated tool to have a more enhanced galling resistance property in addition to the superior wear resistance. Particularly in a case where the lubricant hardly adheres to the coated tool due to the complex shape of the tool and etc., the coated tool having the above-described layers "a", "b" and "c" are effective to minimize the deterioration of the characteristics of the tool, in which it is preferred that the layer "c" provided as the outermost layer of the coating has a surface roughness Rz of 4 to 15 μm.

The method for forming the coating which is provided on the coated tool for warm-and/or-hot working of the present invention is not limited to the methods described above, however, it is preferred, in taking all of the heat influence of the coated substrate, the fatigue strength of the tool and the adhesion of the coating into consideration etc., to use the physical vapor deposition such as the arc discharge ion plating and the sputtering in which the layers can be formed at a temperature less than the tempering temperature of the hot die steel or the high speed steel which is the substrate of the coated tool and in which physical vapor deposition the bias voltage is applied to the side of the coated substrate of the tool.

Further, it is preferred that the substrate to be coated is previously subjected to a surface-hardening treatment such as nitriding, carburizing and etc. to enhance the wear resistance thereof so that the hardness at a depth of 25 $\mu$m from the outermost surface of the substrate may become higher, by not less than 200 HV0.2, than the hardness at a depth of 500 $\mu$m from the outermost surface of the substrate (JIS-Z-2244). In this surface-hardening treatment, it is preferred that the treatment condition is controlled to cause neither nitride layer called a white layer occurring during a nitriding nor compound layer such as a carbide layer occurring during a carburizing treatment or that these unfavorable layer or compound is removed by abrasion etc., because these unfavorable layer or compound acts to deteriorate the adhesion of the layer "a".

Figure 2:
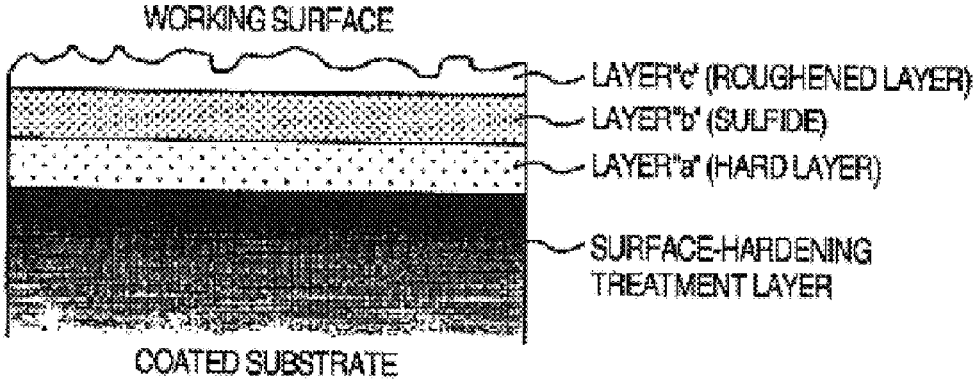
FIG. 2 is a schematic cross sectional view showing the structure of the layers of the coating formed as the working surface of another coated tool for warm-and/or-hot working embodying the invention.

FIG. 1 and FIG. 2 schematically show the layered structure of the coating formed on the working surface of the coated tool for warm-and/or-hot working of the invention. In FIG. 1, the hard layer "a" is formed on the substrate previously subjected to the surface-hardening treatment, and the sulfide layer "b" is formed on the layer "a". In FIG. 2, the layer "c" having the predetermined surface roughness is further formed on the layer "b" of FIG. 1.

Embodiments

Now, the invention is described in detail on the basis of the embodiments, however, the invention is not-limited to the embodiments described below, but can be variously changed within a scope not deviating from the gist of the invention, and they are all included in the technical scope of the invention.

Embodiment 1

The steel of SDK61 defined by JIS was prepared, was oil-quenched at 1030° C., and was then conditioned to have a hardness of 47HRC by tempering at 550~630° C. After that, columnar test pieces having a diameter of 5 mm and a length of 20 mm were formed from the tempered steel for the evaluation of the galling resistance property.

Then, the ion nitriding was performed regarding the test pieces in the condition of maintaining for 10 hours at 550° C. under an atmosphere of $N_2$ (the balance $H_2$) of a flow ratio of 5%. Each of the obtained test pieces was finished to have a mirrored surface by polishing the surface thereof, in which it was confirmed that the hardness thereof in a 25 $\mu$m depth from the outermost surface of the finished surface was higher, by not less than 200 HV0.2, than the hardness in a 500 $\mu$m depth regarding all of the test pieces. Then, the surface of the substrate of each of the finished test pieces were coated by PVD in the conditions described below.

The layer "a" formed on the substrate was provided by the steps of: applying a bias voltage of −400V to the substrate in an Ar atmosphere at a pressure of 0.5 Pa while using a small-sized arc discharging ion plating equipment to perform a plasma cleaning by use of a hot filament for 60 minutes; and coating the layer "a" by using various metal targets as evaporator of the metal composition and a $N_2$ gas as a reaction gas in the condition of a substrate temperature of 500° C., a reaction gas pressure of 3.0 Pa and a bias voltage of −70V so that the layer "a" may have a thickness of 5 $\mu$m.

The layer "b" was formed to have a thickness of 4 $\mu$m by using a sulfide target as a coating source in a small-sized sputtering equipment under the conditions that a bias voltage of −100V was applied to each of the test pieces each provided with the layer "a", that the temperature of each of the test pieces was 300° C., that an Ar atmosphere was set to have a pressure of 0.8 Pa, and that a power of 4 KW was applied to the target.

As regards samples corresponding to the conventional coated tool, test pieces was prepared in which either one of TiN, CrN and $(Ti_{0.45}Al_{0.55})N$ was formed after the aforementioned ion nitriding with the same conditions as those of the layer "a".

In the hot forging tribo-simulation, one end of each of the thus prepared columnar test pieces was attached to the chuck of a drilling machine, and was then subjected for 40 seconds at maximum to a friction sliding contact with a mating block of 20 mm in thickness and of 30 mm×30 mm in size made of JIS-SNCM439 heated to 600° C., while applying a predetermined pressure onto the surface of the test piece, by rotating it at 1540 rpm. In the tests, a specific load at which the test piece was buckled by the friction heat or at which the galling of the test piece occurred to the mating block was evaluated to be a maximum specific load without galling.

In Table 2 there are shown the details of the coating of each of the test pieces and the results of the hot forging tribo-simulation.

TABLE 2

| No. | layer "a" | layer "b" | maximum specific load without galling MPa (maximum 200 Mpa) |
|---|---|---|---|
| | | Samples of the invention examples | |
| 1 | $(Ti_{0.45}Al_{0.55})N$ | $(Mo_{0.80}Cr_{0.20})S_2$ | not less than 200 |
| 2 | CrN | $MoS_2$ | not less than 200 |
| 3 | TiN | $(Mo_{0.60}Ti_{0.25}Cr_{0.15})S_2$ | 170 |
| 4 | $(Ti_{0.85}Si_{0.15})N$ | $(Mo_{0.80}Ti_{0.20})S_2$ | not less than 200 |
| 5 | $(Cr_{0.97}Si_{0.03})N$ | $MoS_2$ | not less than 200 |
| 6 | $(Ti_{0.45}Al_{0.55})N$ | $(Mo_{0.80}Ti_{0.20})S_2$ | not less than 200 |
| 7 | TiN | $MoS_2$ | not less than 200 |
| 8 | CrN | $(Mo_{0.80}Cr_{0.20})S_2$ | not less than 200 |
| 9 | $(Ti_{0.45}Al_{0.55})N$ | $MoS_2$ | not less than 200 |
| 10 | $(Cr_{0.97}Si_{0.03})N$ | $(Mo_{0.80}Ti_{0.20})S_2$ | not less than 200 |
| 12 | CrN | $(Mo_{0.80}Ti_{0.20})S_2$ | not less than 200 |
| 13 | $(Ti_{0.50}V_{0.50})N$ | $MoS_2$ | not less than 200 |
| 14 | $(Ti_{0.50}V_{0.50})N$ | $(Mo_{0.60}Ti_{0.25}Cr_{0.15})S_2$ | 170 |
| 15 | $(Ti_{0.85}Si_{0.15})N$ | $MoS_2$ | not less than 200 |
| | | Conventional samples | |
| 21 | TiN | — | 95 |
| 22 | CrN | — | 100 |
| 23 | $(Ti_{0.45}Al_{0.55})N$ | — | 95 |

As shown in Table 2, because each of the layers in the samples relating to the invention satisfies the limitations and ranges defined in the invention, it is apparent that the maximum specific load without galling in the hot forging tribo-simulation with respect to each of the test pieces is remarkably superior. On the other hand, in the conventional samples in which no layer "b" relating to the present invention was formed, the maximum specific load without galling was extremely low. From the results, it is apparent that, in order to enhance the galling resistance property, it is indispensable to meet the limitations of the invention described above.

Embodiment 2

Then, there was produced a hot forging die for forming a gear having the same layered structure of the surface coating as that of each of the samples Nos. 2, 7, 12 and 13 of the present invention and the conventional samples Nos. 21 and 22 l disclosed in Table 2, and the service life thereof was evaluated in the actual dies.

Specifically, each of the hot forging dies was produced by the steps of: roughly working an improved material of JIS-SKD61 having chemical composition shown in Table 3 to thereby provide a shape similar to the shape of the die; oil-quenching it at 1030° C.; performing the conditioning thereof to have a hardness of 50 HRC by tempering at 550~630° C.; performing the finishing working thereof; performing the nitriding of the surface of each of the finished dies with the same conditions as those of Embodiment 1; and forming the layers by use of the PVD with the same conditions as those of Embodiment 1. In each of the dies, it was also confirmed that the hardness in a 25 $\mu$m depth from the surface thereof after the nitriding and completion of the dies was higher, by not less than 200 HV0.2 higher than the hardness thereof in a 500 $\mu$m depth.

TABLE 3

| | chemical composition/mass % | | | | | | |
|---|---|---|---|---|---|---|---|
| | C | Si | Mn | Cr | Mo | V | Fe |
| die material | 0.34 | 0.30 | 0.60 | 5.20 | 2.60 | 0.70 | Residue |

Each of the manufactured dies had a diameter of 176 mm and a height of 84 mm and was provided at one terminal face thereof a diesinking for forming gears. In the actual operations, a forging press of 1000t was used to hot-forge the works of JIS-SCM420 which was heated up to 1200° C. Table 4 shows the service life of each of the dies used in this actual hot forging.

TABLE 4

| No. | tool service life/pieces | cause of expiration of service life |
|---|---|---|
| | Samples of the invention | |
| 2 | 23,900 | wear |
| 7 | 22,600 | |
| 12 | 24,300 | |
| 13 | 22,800 | |
| | conventional samples | |
| 21 | 6,500 | |
| 22 | 7,300 | |

Each of the service lives of the dies was due to damages caused by the wear thereof, each of the die examples of the invention has an enhanced service life 3 times longer than that of the conventional ones. That is, when applying the invention to the hot forging dies, the galling resistance property is improved, so that the softening of the forging die which is caused by the friction heat is suppressed to thereby make it possible to improve the wear resistance, with the result that the service life of the die is remarkably increased.

Embodiment 3

Then, the effects of the layer "c" relating to the invention were evaluated.

Similarly to the embodiment 1, a steel of JIS-SDK61 was prepared, it being then oil-quenched at 1030° C., and it was conditioned to have a hardness of 47HRC by the tempering thereof at 550~630° C. After that, there were formed columnar test pieces for evaluating the hot galling resistance property each of which test pieces had a diameter of 5 mm and a length of 20 mm, and plate-shaped test pieces for evaluating the adhesion of the lubricant each of which test pieces had a thickness of 3 mm and 30 mm in size.

Regarding each of these test pieces were performed, with the same conditions as those of Embodiments 1 and 2, the ion nitriding, the surface polishing and the PVD for coating the layer "a" (at the bias voltage of −50 V at the time of coating this layer) and the layer "b". Then, as regards the test piece on which the layer "c" defining the outermost layer was to be provided, the layer "c" was formed by use of an arc-discharging type ion plating equipment of a small size, in which a pure-Cu target or another target of the same composition as that used for forming the layer "a" was used as the source of the evaporation, the temperature of the test pieces to be coated being set to be 500° C., the bias voltage being set to be −100V regarding the initial 5 minutes of the coating and being set to be 0 V regarding the later 30 minutes thereof, so that the thickness of the layer "c" was made to be 5 $\mu$m. In this process, when the pure-Cu target was used, the coating of the layer "c" was performed in a $N_2$ gas atmosphere, and the Ar gas atmosphere was used during the coating of this layer when the target used for forming the layer "a" was used, while keeping a pressure of 3 Pa regarding the test pieces Nos. 47, 48 and 49 and another pressure of 13 Pa regarding the other test pieces each provided with the layer "c".

As regards conventional examples, there were prepared test pieces in each of which the layer of TiN, CrN or $(Ti_{0.50}Al_{0.50})N$ was formed in same conditions as the coating of the layer "a" after the ion nitriding of the test piece.

Regarding the test pieces thus obtained, the surface roughness thereof was measured as to an area of 3 mm in length on the test surface of the plate-shaped test piece by using a scanning laser microscope OLS1000, manufactured by Olympus Optic Co., Ltd. After that, the lubricant adhesion was evaluated, and the hot forging tribo-simulation was performed. The evaluation of the lubricant adhesion was performed by the steps of heating the test pieces up to 300° C., preparing a solution of a white color type lubricant (HOTAQUALUB #300TK manufacture by Daido Chemical Industry Co., Ltd.) adjusted to a concentration of 10%, spraying the solution onto the test pieces at a rate of 2.0 ml/s for 2 seconds at a distance of 470 mm, and measuring the amount of the lubricant adhered on the surface of each of the test pieces. The hot forging tribo-simulation was evaluated in the same manner as that of the aforementioned embodiment 1.

In Table 5 are shown the details of the layers regarding each of the test pieces, and the results of the evaluation of the lubricant adhesion and of the hot forging tribo-simulation. As regards the conventional examples which do not meet the requirements of the layers limited in the present invention, it is obscure that the layer formed on each of the test pieces should be sorted to the layer "a" or "b" or "c". However, in order to make the comparison with the present invention clear, the formed layer is sorted for convenience to correspond to the layer "a" relating to the invention, as apparent in Table 5.

TABLE 5

| No. | layer "a" | layer "b" | layer "c" | surface roughness Rz $\mu$m | amount of adhered lubricant × $10^{-3}$ mg/mm$^2$ | maximum specific load without galling MPa (maximum 200 Mpa) |
|---|---|---|---|---|---|---|
| | | | Samples of the invention | | | |
| 31 | $(Ti_{0.50}Al_{0.50})N$ | $(Mo_{0.75}Cr_{0.25})S_2$ | Cu | 8.1 | 3.85 | not less than 200 |
| 32 | CrN | $MoS_2$ | Cu | 8.3 | 3.88 | not less than 200 |
| 33 | TiN | $(Mo_{0.60}Ti_{0.30}Cr_{0.10})S_2$ | Ti | 6.5 | 3.05 | 185 |
| 34 | $(Ti_{0.75}Si_{0.25})N$ | $(Mo_{0.70}Ti_{0.30})S_2$ | Cu | 8.0 | 3.79 | not less than 200 |
| 35 | $(Cr_{0.95}Si_{0.05})N$ | $MoS_2$ | Cu | 8.4 | 3.86 | not less than 200 |
| 36 | $(Ti_{10.50}Al_{0.50})N$ | $(MO_{0.70}Ti_{0.30})S_2$ | TiAl | 7.8 | 3.43 | not less than 200 |
| 37 | TiN | $MoS_2$ | Cu | 8.3 | 3.82 | not less than 200 |
| 38 | CrN | $(Mo_{0.75}Cr_{0.25})S_2$ | Cr | 7.8 | 3.21 | not less than 200 |
| 39 | $(Ti_{0.50}Al_{0.50})N$ | $MoS_2$ | Cu | 8.2 | 3.75 | not less than 200 |
| 40 | $(Cr_{0.95}Si_{0.05})N$ | $(Mo_{0.70}Ti_{0.30})S_2$ | Cu | 8.1 | 3.68 | not less than 200 |
| 41 | TiN | $(Mo_{0.70}Ti_{0.30})S_2$ | Cu | 8.3 | 3.81 | not less than 200 |
| 42 | CrN | $(Mo_{0.70}Ti_{0.30})S_2$ | Cr | 7.7 | 3.15 | not less than 200 |
| 43 | $(Ti_{0.50}V_{0.50})N$ | $MoS_2$ | Cu | 8.0 | 3.76 | not less than 200 |
| 44 | CrN | $(Mo_{0.70}Ti_{0.30})S_2$ | Cu | 8.2 | 3.85 | not less than 200 |
| 45 | $(Ti_{0.50}V_{0.50})N$ | $(Mo_{0.60}Ti_{0.30}Cr_{0.10})S_2$ | TiV | 6.8 | 3.01 | 190 |
| 46 | $(Ti_{0.75}Si_{0.25})N$ | $MoS_2$ | Cu | 8.3 | 3.77 | not less than 200 |
| 47 | $(Ti_{10.50}Al_{0.50})N$ | $MoS_2$ | Cu | 2.1 | 1.14 | not less than 200 |
| 48 | CrN | $MoS_2$ | Cu | 2.3 | 1.05 | not less than 200 |
| 49 | CrN | $(Mo_{0.70}Ti_{0.30})S_2$ | Cr | 2.2 | 0.69 | not less than 200 |
| 50 | $(Ti_{10.50}Al_{0.50})N$ | $MoS_2$ | — | 2.4 | 0.66 | not less than 200 |
| 51 | CrN | $MoS_2$ | — | 2.3 | 0.53 | not less than 200 |
| | | | comparative sample | | | |
| 61 | CrN | — | Cu | 8.2 | 3.84 | 110 |
| | | | conventional samples | | | |
| 71 | TiN | — | — | 2.4 | 0.32 | 90 |
| 72 | CrN | — | — | 2.4 | 0.47 | 100 |
| 73 | $(Ti_{10.50}Al_{0.50})N$ | — | — | 2.6 | 0.35 | 100 |

As shown in Table 5, in the samples of the invention in which the structure of the coating satisfies the limitations of the invention, the maximum specific load without galling is high in the hot forging tribo-simulation test, that is, the galling resistance property thereof is superior. In the samples of the invention, ones which satisfy the limited, preferred range of the surface roughness are remarkably superior not only in the maximum specific load without galling measured in the hot forging tribo-simulation test but also in the adhesion of the lubricant.

On the other hand, since a comparative sample No. 61 is out of the limitations defined in the invention, the maximum specific load without galling thereof becomes very low due to no layer "b" (the sulfide layer) although the lubricant adhesion thereof is superior. The adhesion of lubricant and the maximum specific load without galling of the conventional samples are greatly inferior to those of the examples of the invention.

Figure 3:
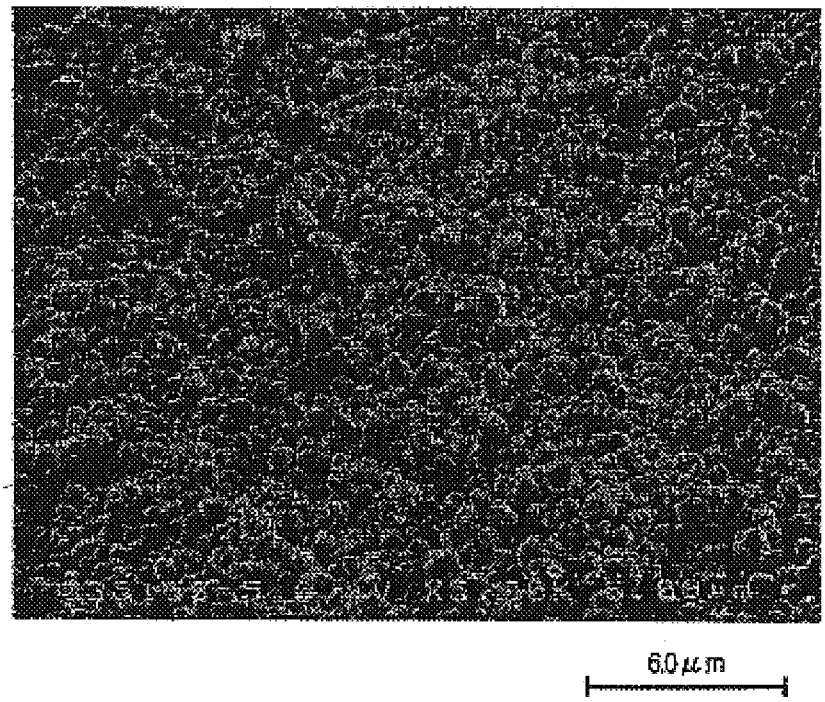
FIG. 3 is a surface SEM image of a sample No.32 embodying the invention, which is a microscope photograph showing an example of the invention.

Incidentally, FIG. 3 is the SEM image of the surface of the sample No. 32 relating to the invention, and it is observed that the surface of the sample is covered with knotty particles of about 1 $\mu$m in particle size.

Embodiment 4

In this embodiment were formed warm forging punches for forming cups each of which punches was provided with the same layered structure of the surface coating as that of each of the samples Nos. 31, 32, 41 and 44 and of each of the conventional samples Nos.72 and 73 shown in Table 5, each of these punches was evaluated regarding the service life thereof by use of an actual die.

Specifically, a high speed steel based, toughness-improved material having a chemical composition shown in Table 6 was roughly worked into masses each having a shape similar to the shape of a punch, the masses being oil-quenched at 1080° C. and being tempered at 600° C. to thereby have a hardness of 55HRC, and then the masses were subjected to the finishing work so that dies were prepared. After that, each of the punches was subjected to the nitriding and the coating treatment by PVD with the same conditions as those of Embodiment 3, in which it was confirmed that the hardness in a 25 $\mu$m depth from the surface of the steel of each of the punches was 200 HV0.2 higher than the hardness in a 500 $\mu$m depth from the surface thereof after the nitriding and the finishing working.

TABLE 6

| | chemical composition/mass % | | | | | | | | |
|---|---|---|---|---|---|---|---|---|---|
| | C | Si | Mn | Cr | W | Mo | V | Co | Fe |
| punch material | 0.50 | 0.15 | 0.45 | 4.20 | 1.50 | 2.00 | 1.20 | 0.75 | the balance |

Each of the punches manufactured as above had a diameter of 110 mm and a height of 300 mm and was provided at the terminal portion thereof with a cup-forming punch. By using each of the dies and a forging press of 1600t, works of JIS S45C heated to 750° C. were forged.

Table 7 shows service life of the punches.

TABLE 7

| No. | tool service life/pieces | cause of expiration of service life |
|---|---|---|
| | samples of the invention | |
| 31 | 15,900 | wear |
| 32 | 16,600 | |
| 41 | 16,300 | |
| 44 | 17,800 | |
| | conventional samples | |
| 72 | 5,100 | local scrapping |
| 73 | 3,500 | |

Each of the punches to which the invention is applied has an improved sevice life over 3 times longer than those of conventional punches. In addition, in each of the punches relating to the invention, the service life thereof was observed due to damages caused by the wear, however, in each of the punches of the conventional samples the service life was due to the escalation of such damages as a galling occurred on a front, curved portion of the punch at an early stage of the warm forging and as a local scraping occurred after the galling. Thus, it was observed that, by applying the invention to the warm-forging punches, the service life of each of the punches was enhanced very much.

In this embodiment are described the case of the nitride regarding the layer "a", however, it was also possible, in the cases of the carbide and the carbonitride which were used as the layer "a", to obtain the same advantages as that of the nitride.

As described above, the galling resistance is remarkably improved by applying the layered structure of the coating defined by the invention. As the result thereof, it is possible to remarkably increase the wear resistance of the warm-and/or-hot working tool, so that the service life of the tool can be enhanced very much.

What is claimed is:

1. A coated tool in use in warm-and/or-hot working with a superior galling resistance property and a superior wear resistance, comprising:

a base material selected from the group consisting of a hot die steel and a high speed steel; and a coating as a working surface, said coating having: a layer "a" provided on said base material, said layer "a" being made of at least one substance selected from the group consisting of a nitride, a carbide and a carbonitride, each of which contains as the main constituent thereof at least one metal element selected from the group consisting of Ti, V, Cr, Al and Si; and a layer "b" provided on said layer "a", said layer "b" being made of a sulfide, further comprising a layer "c" having a surface roughness Rz of 4 to 15 μm, said layer "c" being an outermost layer of the coating.

2. A coated tool according to claim 1, wherein the layer "b" of the sulfide consists, by atomic % in terms of only metal composition, of at least one substance not more than 50% in total (0% inclusive) selected from the group consisting of Ti and Cr, and the balance substantially Mo, said layer "b" having a thickness of 0.5 to 10 μm.

3. A coated tool according to claim 1, wherein the layer "c" contains as the main constituent thereof at least one metal element selected from the group consisting of Ti, V, Cr, Al, Si and Cu, said layer having a thickness of 2 to 15 μm.

4. A coated tool according to claim 2, wherein the layer "c" contains as the main constituent thereof at least one metal element selected from the group consisting of Ti, V, Cr, Al, Si and Cu, said layer having a thickness of 2 to 15 μm.

5. A tool according to claim 1, wherein each of the layers is provided by a physical vapor deposition.

6. A tool according to claim 2, wherein each of the layers is provided by a physical vapor deposition.

7. A tool according to claim 4, wherein each of the layers is provided by a physical vapor deposition.

8. A tool according to claim 1, wherein a hardness in a 25 μm depth from the outermost face of said base material is higher, by not less than 200 HV0.2, than a hardness in a 500 μm depth from the outermost face of said base material.

9. A tool according to claim 2, wherein a hardness in a 25μm depth from the outermost face of said base material is higher, by not less than 200 HV0.2, than a hardness in a 500 μm depth from the outermost face of said base material.

10. A tool according to claim 3, wherein a hardness in a 25 μm depth from the outermost face of said base material is higher, by not less than 200 HV0.2, than a hardness in a 500 μm depth from the outermost face of said base material.

11. A tool according to claim 5, wherein a hardness in a 25 μm depth from the outermost face of the substrate is higher, by not less than 200 HV0.2, than a hardness in a 500 μm depth from the outermost face of said base material.

12. A tool according to claim 7, wherein a hardness in a 25 μm depth from the outermost face of the substrate is higher, by not less than 200 HV0.2, than a hardness in a 500μm depth from the outermost face of said base material.

* * * * *